US005864745A

United States Patent [19]

Kawagoe et al.

[11] Patent Number: 5,864,745

[45] Date of Patent: Jan. 26, 1999

[54] SWASH PLATE OF A SWASH-PLATE TYPE COMPRESSOR

[75] Inventors: Kimio Kawagoe; Soo-Myung Hon; Kenji Takenaka; Manabu Sugiura; Eiji Tokunaga, all of Aichi, Japan

[73] Assignees: Taiho Kogyo Co., Ltd., Toyota; Kabushiki Kaisha Toyoda Jidoshokki Seisakusho, Kariya, both of Japan

[21] Appl. No.: 537,855

[22] PCT Filed: Mar. 16, 1995

[86] PCT No.: PCT/JP95/00441

§ 371 Date: Nov. 16, 1995

§ 102(e) Date: Nov. 16, 1995

[87] PCT Pub. No.: WO95/25224

PCT Pub. Date: Sep. 21, 1995

[30] Foreign Application Priority Data

Mar. 16, 1994 [JP] Japan ..... 6-071652
Feb. 3, 1995 [JP] Japan ..... 7-039220

[51] Int. Cl.[6] ..... B05D 5/08; B05D 3/12

[52] U.S. Cl. ..... 428/553; 427/455; 427/456

[58] Field of Search ..... 428/535, 548, 428/553; 427/455, 456

[56] References Cited

U.S. PATENT DOCUMENTS 4,037,522 7/1977 Inoshita et al. .
5,087,529 2/1992 Engel et al. .

FOREIGN PATENT DOCUMENTS 49-109917 10/1974 Japan .
53-129311 11/1978 Japan .
54-163414 12/1979 Japan .

*Primary Examiner*—Daniel J. Jenkins
*Attorney, Agent, or Firm*—Aarmstrong, Westerman, Hattori, McLeland & Naughton

[57] ABSTRACT

In order to enhance the seizure resistance of a swash plate, which is the sliding part of a swash-plate type compressor, copper alloy is flame-sprayed on the swash plate. Depending upon the necessity, the following control of structure/composition: (a) a mixed structure is provided such that atomized bronze powder, which is melted during flame spraying, and an unmelted atomized structure are mixed; (b) Pb is not contained or contained slightly in the melted structure: (c) Sn, P, Al, Ag, Si, Mn, Cr, Ni, Zn, Pb and/or Bi is added to the copper; (d) hard matters are added to copper alloy; and, (e) an intermediate layer of Ni or the like is formed between the flame-sprayed layer and the substrate, is carried out.

15 Claims, 17 Drawing Sheets

(1)

(2)

(3)

SWASH PLATE OF A SWASH-PLATE TYPE COMPRESSOR

TECHNICAL FIELD

The present invention relates to a swash plate of a swash-plate type compressor and a method for preparing its sliding layer. More particularly, the present invention relates to a surface-treating technique for outstandingly improving, in a swash-plate type compressor, the sliding properties of a swash-plate which consists of an iron-based or aluminum-based material.

BACKGROUND TECHNIQUE

In the swash-plate type compressor, a swash-plate is rigidly secured obliquely to a rotary shaft or is secured obliquely to a rotary shaft in such a manner that its slanting angle is variable. The compression and expansion are carried out by means of the swash-plate which increases or decreases the volume of a partition space within a compressor, depending upon the rotation of the rotary shaft. Such swash plate is caused to slide on a sliding member referred to as a shoe. Air-tight mutual sealing is attained between parts, so that the cooling medium can be compressed and expanded in the stated space.

A noticeable point in the sliding conditions of a swash-plate is that, during the initial operational period of a compressor, the cooling medium reaches the sliding part prior to the lubricating oil reaching the sliding part between the swash plate and the shoe; thus the cooling medium has a rinsing effect on the lubricating oil which remains on the sliding part, with the result that the sliding condition is in a dry condition free of lubricating oil. The sliding condition requirements of the swash plate are therefore very severe.

The sliding properties, which are required for a swash-plate used under the condition described above, are seizure resistance, wear resistance, and the like. Proposals have thus been made to add hard matters into the aluminum material for enhancing the wear resistance, to improve the material of the swash plate, and to subject an iron-based swash-plate to heat treatment for enhancing the hardness and hence wear-resistance.

In addition, the following surface treating methods are also proposed.

One of the present applicants proposed in Japanese Unexamined Patent Publication No. Sho 51-36611 to bond sintered Cu material on the shoe in the case of an iron-based swash plate. That is, an iron-based swash plate was heretofore subjected to hardening treatment. However, when the material of the opposed member, i.e., the shoe, is an iron-based material, the sliding takes place between identical kinds of materials thereby involving a problem that a seizure is liable to occur. Sintered copper alloy is used for the opposing material (shoe) opposed to an iron-base swash plate, so as to avoid the above mentioned problem.

In addition, it was also proposed to apply tin plating on the iron-based swash-plate so as to avoid the sliding between identical kinds of materials and hence to enhance the seizure resistance.

Since the tin plating applied on an iron-based swash-plate is soft, a problem that arises is insufficient wear-resistance. Furthermore, although a hard element added to an aluminum alloy enhances wear resistance, a problem that arises is insufficient seizure resistance.

It is therefore an object of the present invention to enhance the performance and reliability of a swash-plate type compressor by means of providing on the surface of an iron-based or aluminum-based swash plate a surface layer which exhibits improved both seizure resistance and wear resistance.

DISCLOSURE OF INVENTION

The present inventors extensively considered and experimented on a surface treating method, which can solve the above mentioned problems and discovered the following. The flame-sprayed copper alloy has, as compared with the sintered alloy, (a) fine structure, and (b) high hardness provided for the identical composition. Furthermore, (c) it is possible to adjust the structure, by means of adjusting the spraying condition, from a completely melted one to one in which the shape of the atomized powder or the structure is partly retained, thereby making it possible to change the sliding properties in conformity with the usage conditions. It was discovered that improved seizure resistance and wear resistance are provided, when these properties are utilized.

The invention, which is completed based on such discoveries, is related to a swash plate, which consists of an iron-based or aluminum-based material and is used in a swash-plate type compressor, and is characterized in that a flame-sprayed layer of a copper-based alloy, which contains, by weight percentage, not less than 0.5% in total, preferably not less than 1% and not more than 50%, of one or more kind selected from a group consisting of not more than 40% of lead, not more than 30% of tin, not more than 0.5% of phosphorus, not more than 15% of aluminum, not more than 10% of silver, not more than 5% of silicon, not more than 5% of manganese, not more than 5% of chromium, not more than 20% of nickel, and not more than 30% of zinc, is formed on at least the sliding surface with respect to the shoe, preferably an iron-based shoe. The percentage in the present invention is weight percentage unless otherwise specified.

The construction of the present invention is described hereinafter.

In the above mentioned copper-based alloy, a part of lead is present as lead particles and provides compatibility and low-friction property. The other part of the lead element is solid-dissolved to strengthen the copper matrix and provides wear resistance and seizure resistance. Lead is the most preferred element for enhancing the sliding properties under a dry condition. However, when the lead content exceeds 40%, the strength of the copper alloy decreases. It is therefore necessary that the maximum limit is 40%. A preferred lead content is from 1 to 30%. A more preferred lead content is from 2 to 15%.

The additive elements other than lead are mainly solid-dissolved in copper and enhance the wear resistance and seizure resistance. Among them, silver outstandingly enhances the sliding properties under a condition with slight lubricating oil. With regard to the amount of addition, tin precipitates at an amount of not less than 10%, silicon and manganese precipitates at an amount of not less than 1%, and the precipitates enhance the wear resistance. Heat conductivity, good sliding property with respect to an iron-based or aluminum-based opposing material, wear resistance and seizure resistance, which are inherent properties of copper, are lost, when tin exceeds 30%, phosphorus exceeds 0.5%, aluminum exceeds 15%, silver exceeds 10%, silicon exceeds 5%, manganese exceeds 5%, chromium exceeds 5%, nickel exceeds 20%, and zinc exceeds 30%. These elements must therefore not exceed the above mentioned maximum limit. Preferred contents are: from 0.1 to 20% for tin; from 0.2 to 0.5% for phosphorus; from 0.5 to 10% of aluminum; from 0.1 to 3% for silicon; from 0.1 to 8% for silver; from 0.5 to 4% for manganese; from 0.5 to 3% of chromium, from 0.5 to 15% for nickel; and, from 5 to 25% for zinc. More preferred contents are: from 0.1 to 15% for tin; from 1 to 8% of aluminum; from 0.5 to 1.5% for silicon; from 0.2 to 5% for silver; from 0.5 to 3% for manganese; from 1 to 2% for chromium; from 1 to 10% for nickel; and, from 10 to 20% for zinc. The total amount of the additive elements should be within a range of from 0.5 to 50% for the reasons described above.

The shoe per se is known. A shoe, which can be used, is disclosed, for example, in Japanese Unexamined Patent Publication No. Sho. 51-36611 filed by one of the present applicants, and has a sliding surface consisting mainly of iron. Bearing steel is preferred. Methods for producing a shoe are not at all limited. Such techniques as rolling, forging, powder-metallurgy and surface hardening can be optionally employed for the production of a shoe.

BEST MODE FOR CARRYING OUT THE INVENTION

A characteristic point of the metal structure of the flame-sprayed layer is that the atomized copper-powder is melted. More specifically, the droplets, which have been melted and hence formed in the flame of flame-spraying, are impinged upon the surface of the swash plate and then deformed. As seen in the cross section of the layer, portions in laminar form, flaky form or in a flat plate are laminated on one another. As seen on the flat plane, the small discs, fish scales, and the like are laminated on one another. The flame-sprayed layer according to the present invention may have such a structure as a whole.

Figure 1:
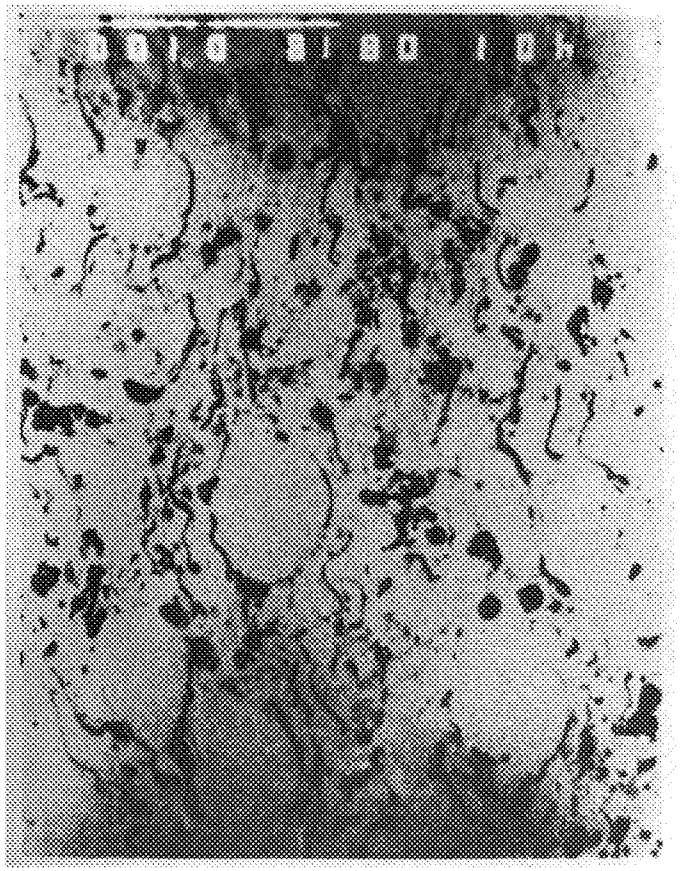
FIG. 1 is a metal-structure photograph of a Cu—Al alloy flame-sprayed layer at its cross section (magnified 320 times).
Figure 2:
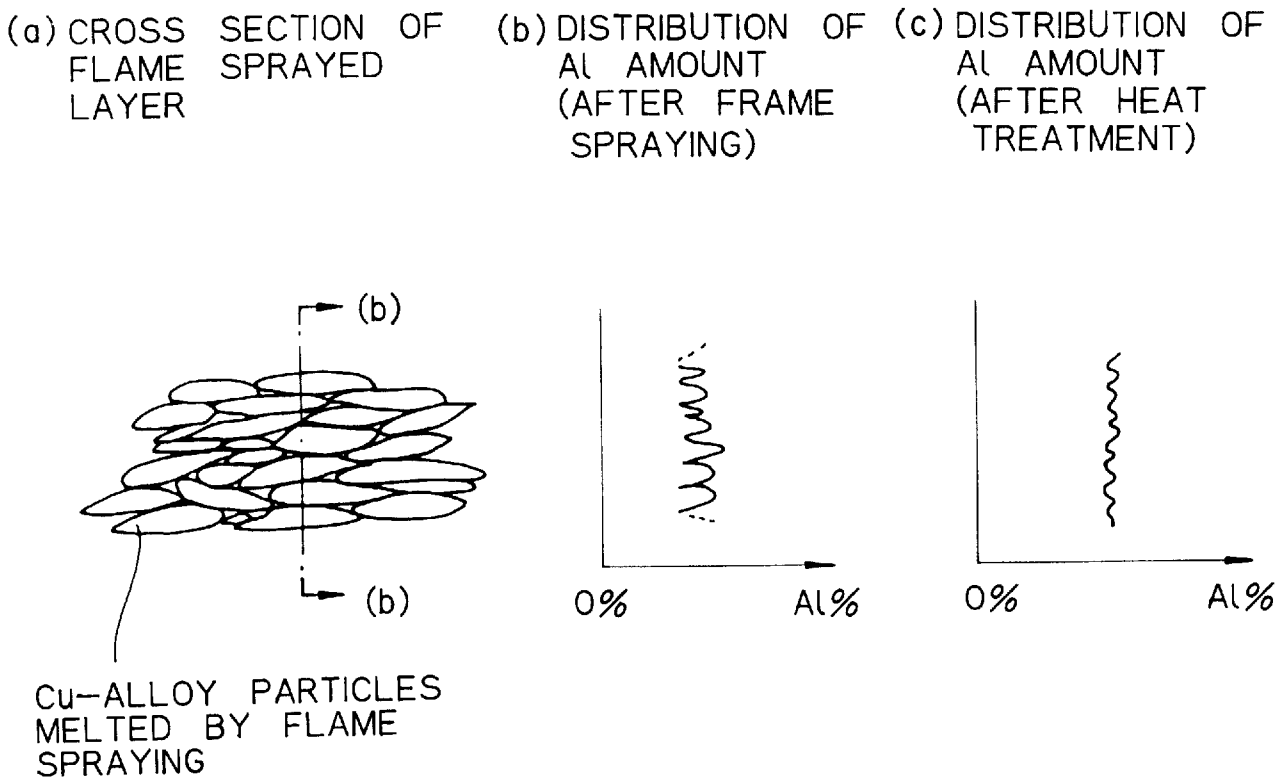
FIG. 2 is a schematic drawing of the metal-structure of a Cu—Al alloy flame-sprayed layer at its cross section and distribution of Al amount.

The flame-sprayed structure has, in addition to the above mentioned characteristic, the following characteristics. That is, when the atomized powder is forcedly supplied under pressure of gas into the flame, the atomized powder maintains the form of isolated particles, the particles being scattered. The atomized powder seems to be melted as it is, although a part of the particles may be incorporated with one another. Molten droplets impinge upon the swash plate and solidify. When the thickness of the flame-sprayed layer is decreased to accelerate the cooling speed, one droplet or a few droplets are not incorporated with the other numerous droplets but solidify as independent particles. The droplets, which are relatively small, collapse and are laminated on one another in the form of numerous fine laminar pieces, as described above. The droplets as a whole form the flame-sprayed layer. An example of such flame-sprayed layer is illustrated in FIG. 1 showing a microscopic, photograph of Cu—8% Al alloy. In the flame-sprayed structure as shown in this drawing, the components are distributed in the entire flame-sprayed structure as schematically shown in FIG. 2(b). That is, the solidification segregation is repeated in the fine laminar pieces and the number of repeating is the same as that of these pieces. Macroscopically observed, the distribution of components is uniform. Such uniformity in the components is believed to stabilize the sliding properties and is desirable particularly in the light of stabilizing the friction force. Incidentally, when the flame-sprayed layer was subjected to heat treatment at an appropriate temperature below the melting point so as to lessen the solidification segregation and to attain uniformity of the components even in the fine laminar pieces (FIG.(c)), the sliding properties were further improved. However, when the material was considerably softened by the heat treatment, a tendency towards deterioration of the sliding properties arose.

In addition, it is preferred in the present invention that a part of the atomized powder does not melt but remains in the flame-sprayed layer.

Hereinafter are described the features of the mixed structure of the melted structure and the unmelted structure of atomized powder with regard to Cu—Pb alloy.

Figure 3:
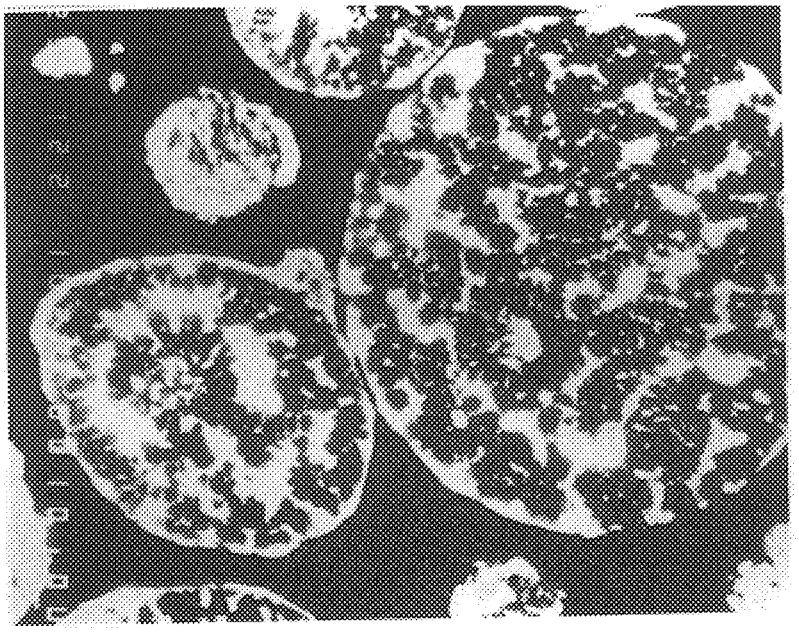
FIG. 3 is a metal-structure photograph of an atomized Cu—Pb alloy powder (magnified 1000 times).
Figure 4:
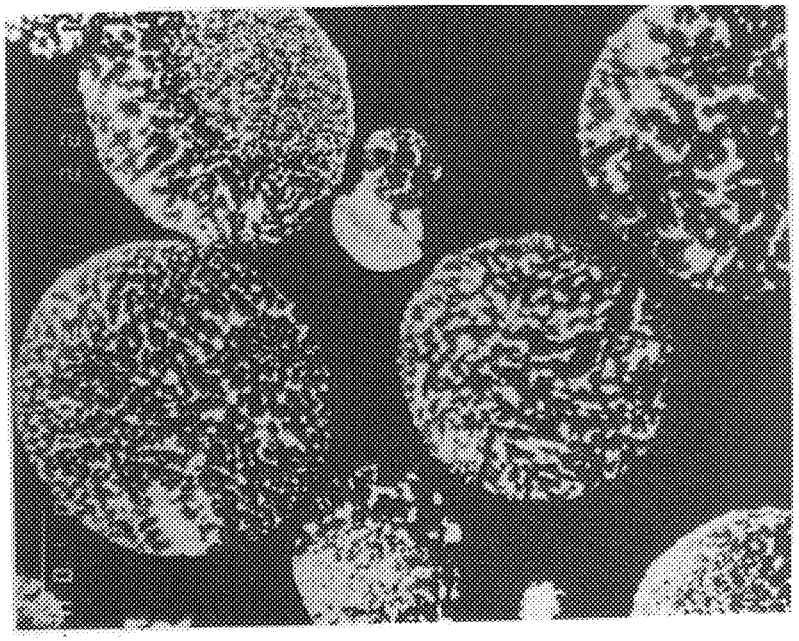
FIG. 4 is a metal-structure photograph of an atomized Cu—Pb alloy powder (magnified 1000 times).

The unmelted structure of lead-bronze atomized powder (hereinafter referred to as "the atomized structure"), of which the above mentioned structure is comprised, is the rapidly cooled structure of atomized lead-bronze powder, which structure does not disappear while the powder is in the flame but is left in the flame-sprayed layer. In the structure of this atomized powder, the phases mainly composed of lead disperse in a fine particulate form or distributes along the copper boundaries as is typically shown in FIG. 3 showing a microscopic structure of Cu—24% Pb alloy. This structure is one type of cast structure, but is characterized by: (1) the predominant cooling direction is from the periphery to the interior of a particle; (b) more rapidly cooled structure than the ordinary ingot casting or continuous casting, and the lead is fine particles, whose diameter is typically 10 microns or less; or, (c) lead distributes along the copper boundaries in the form of a network. Incidentally, the structure of FIG. 3 is a case of uniform cooling, while in the case of FIG. 4, a part of the periphery of the particles is so intensively cooled as to form fine-sized particles in this part, and the lead particles are coarse where the cooling is weak.

According to one form of the present invention, i.e., the mixed structure, the lead is forcedly solid-dissolved in the copper alloy. The so-formed structure in the flame-sprayed structure is hereinafter referred to as "the forcedly solid-dissolved flame-sprayed structure". In this mixed structure, the lead is forcedly solid-dissolved in the laminar structure, which is produced by melting the droplets within the flame of the flame spray, impinging the droplets on the substrate of a swash plate, and compressing them flat.

Figure 5:
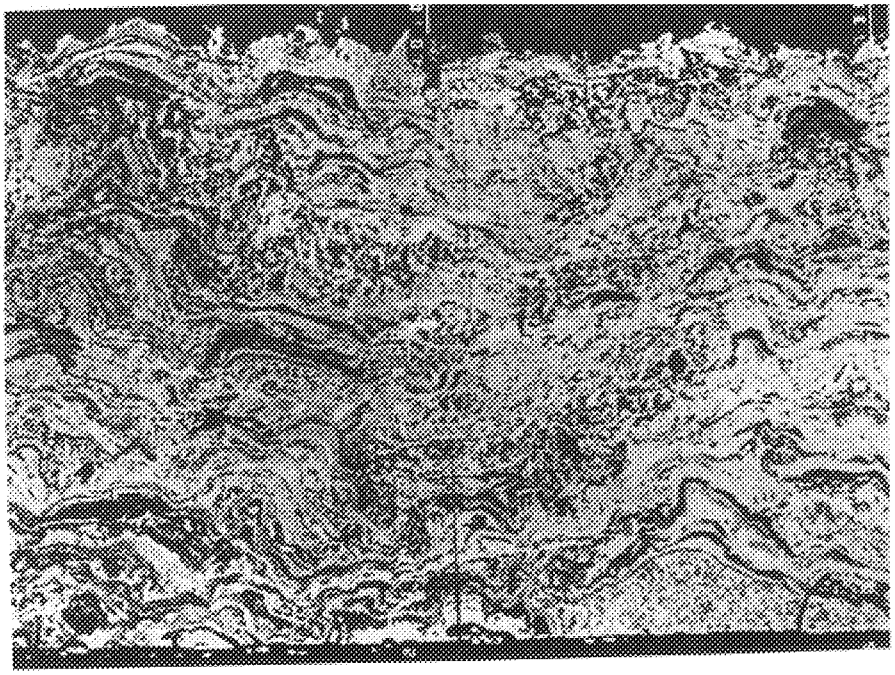
FIG. 5 is a metal-structure photograph of a flame-sprayed layer, in which the atomized structure and the forcedly solid-dissolved flame-sprayed structure are mixed.

As shown in FIG. 5, the atomized structure, which is said to be an equilibrium structure (white lead phases are observed), and a forcedly solid-dissolved flame-sprayed structure, which is said to be a non-equilibrium structure (no white lead phases are observed) are mixed in these mixed structures.

FIG. 5 shows an example of the flame-sprayed structure according to the present invention (the white particles or pattern correspond to the lead) and elucidates the following points.

The atomized structure corresponds to approximately 13% by area in this structure, while the laminar portions, where no lead phases are recognized, comprise the remaining 87% by area. In these laminar portions, lead is forcedly solid-dissolved. Since the atomized powder collapses, when it impinges upon the backing metal, or since the outer side of the atomized powder may be probably melted, the remaining atomized structure has an outer configuration which is quite different from that of the powder. However, the lead morphology in the powder is maintained even after the flame spraying.

Figure 6:
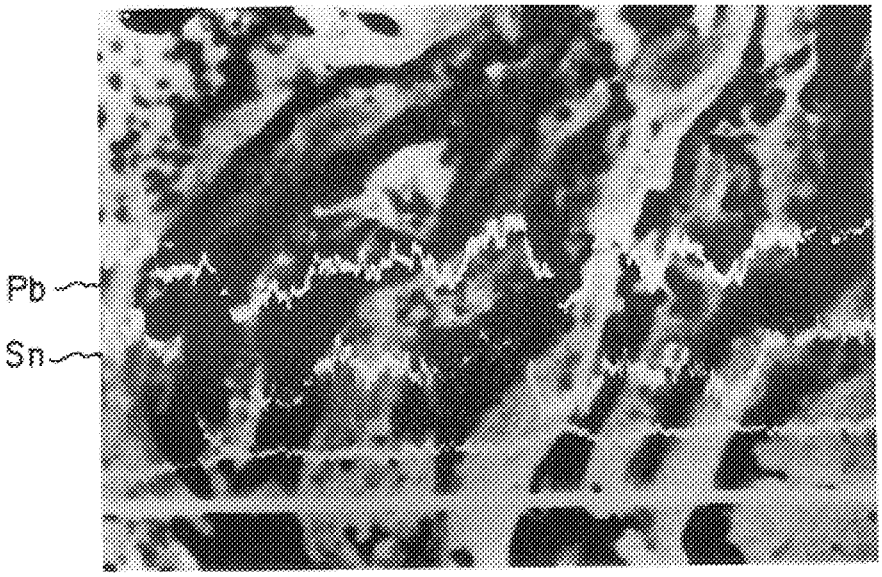
FIG. 6 is an electron-microscope photograph of a forcedly solid-dissolved flame-sprayed structure depicting an EPMA analysis chart (magnified 3000 times).

FIG. 6 is an EPMA photograph of the flame-sprayed Cu—10% Pb—10% Sn layer and shows the forcedly solid-dissolved flame-sprayed structure by the cross section of the layer. This photograph shows that Pb and Sn are present, although the presence of particles is not identified. Incidentally, since the solubility of Pb in Cu is slight, Pb is forcedly solid-dissolved. Since Sn is solid-dissolved under an ordinary casting condition, its solid-solution is not a forced one. The sliding properties of the respective components of the flame-sprayed layer are described below.

Since numerous, fine lead particles are present in the atomized structure, its compatibility, low-friction property, and lubricating property are excellent. In addition, the atomized powder has usually 100 $\mu$m or less than of the particle diameter, and the structure of the respective particles is virtually identical. There is therefore uniformity in the structure of the particles. Therefore, the lead particles disperse uniformly in the sliding material, when such atomized structure is maintained in the sliding material, so that the sliding properties are stabilized.

The forcedly solid-dissolved flame-sprayed structure has a high hardness amounting to approximately Hv 200 or more, because lead is forcedly solid-dissolved. The forcedly solid-dissolved flame-sprayed structure has thus excellent wear resistance. In addition, as the powder is once melted on the backing metal after flame spraying, this structure can enhance the strength of bond with the backing metal.

A stripe pattern is noticeable in FIG. 6 showing the forcedly solid-dissolved flame-sprayed structure. The solid-solution amount of Pb and Sn is large in the white portions of the stripe pattern. It is presumed from the stripe pattern that the flame-spraying deposited amount of material per unit time changes periodically or in a pulsatory manner, and, further, the cooling speed increases or decreases corresponding to the above change. The above mentioned fact is interesting. However, it is needless to say that this fact does not limit the forcedly solid-dissolved flame-sprayed structure according to the present invention.

It is not preferred that either one of the atomized structure or forcedly solid-dissolved flame-sprayed structure is excessively abundant. It is therefore desirable that the atomized structure is preferably from 2 to 70% by area, more preferably from 2 to 50% by area. It is essential here that the flame-sprayed layer essentially totally consists of the atomized structure and the forcedly solid-dissolved flame-sprayed structure. Any structure other than the above mentioned one, for example, a precipitated lead structure, in which lead is not forcedly dissolved in the flame-sprayed lead-bronze alloy but precipitates, may be mixed, provided that its amount is a little. However, the targeted upper limit of such structure is 10% by area.

The present inventors conducted research to control the structure of flame-sprayed sliding layer from a point of view different from the a point of view of constructing the layer structure and the forcedly solid-dissolved flame-sprayed structure. As a result, the sliding performances could be further enhanced as is described hereinafter.

Lead plays mainly the role of a lubricating effect on the bronze (the bronze means in the present invention a copper alloy, in which tin is not an essential element). The lead phases in the atomized structure implement this effect in the flame-sprayed bronze. Lead is solid-dissolved in the copper matrix, when the forcedly solid-dissolved flame-sprayed structure is formed by the flame spraying. Although a part of the lead phases may be in a laminar form, since copper, tin and the like are solid-dissolved in the lead phases, the lubricating effect is not expected to realized.

Meanwhile, when the particles of atomized powder are melted during flame spraying, they solidify around the non-melted atomized powder and on the substrate surface and enhance the adhesion properties of the flame-sprayed layer during solidification and strengthen the flame-sprayed layer. However, the lead of the forcedly solid-dissolved flame-sprayed structure may precipitate in the grain boundaries due to heat generated in the sliding. In addition, the segregated parts in a long laminar form are of low strength. The forcedly solid-dissolved flame-sprayed structure may therefore exert a detrimental effect upon the adhesion of the flame-sprayed layer and its strengthening.

When sliding material is covered with a flame-sprayed bronze layer which contains network or granular lead-phases in the atomized structure, and is subjected to stress parallel to the plane, since the strength of lead is lower than that of copper, cracks run along the layer of the laminar lead-phases, and, hence the cracking occurs under a relatively low stress. Contrary to this, the fine particulate lead-phases have a high resistance against the cracking.

It is preferred that lead is completely absent or is contained 3% at the most in the melted structure, i.e., a region in which the atomized powder, which has been melted during flame-spraying transportation or on the backing metal, is caused to flow and solidifies on the backing metal in a different form from the one before spraying, without retaining such as laminar form, flaky form or the like before flame-spraying. This melted structure is hereinafter referred to as "the lead-free melted structure". Lead present in the melted structure in an amount exceeding 3% based on such structure not only fails to exhibit any lubricating effect, but also becomes a cause for impairing the properties of the entire lubricating layer except for the wear resistance. Lead is therefore preferably present in the starting powder of flame spraying, which does not undergo any melting in the process from the flame-spraying transportation until the layer formation by spraying, i.e., in the unmelted structure. The flame-sprayed structure consisting of the lead-free melted structure and such lead-containing unmelted structure is hereinafter referred to as the "lead-segregated structure".

The powder may be crushed powder, but atomized powder is preferably used because it is appropriate for flame spraying. The lead-segregated structure, which is a characteristic of the present invention, is hereinafter described. An example of the atomized powder, which forms such structure, is described.

Figure 7:
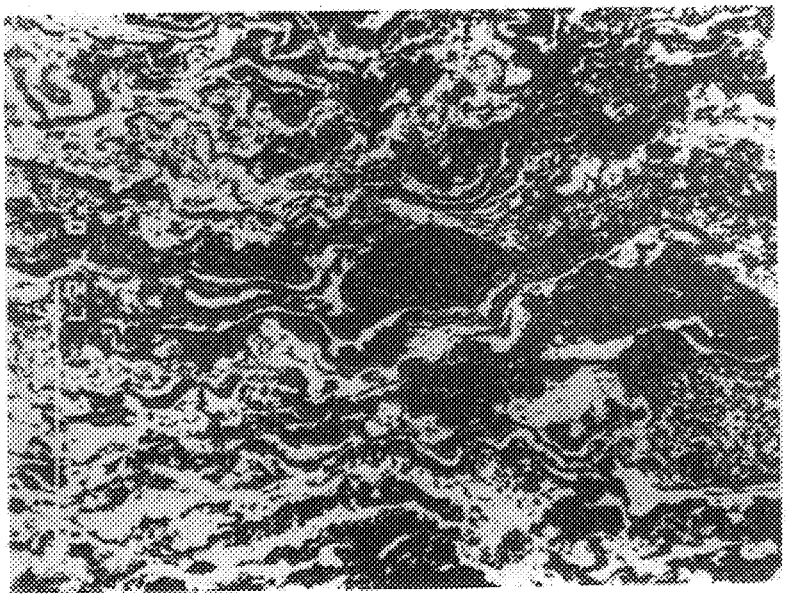
FIG. 7 is a metal microscope photograph of flame-sprayed strucuture having a lead-free melted structure (magnified 320 times).

FIG. 7 is an optical microscope photograph of the flame-sprayed layer obtained in the later described Example 4. In this drawing, a few parts appearing mainly as white nodules are the unmelted structure of the atomized bronze (copper-tin-lead). What appears mainly black is the melted structure of bronze (copper-tin). A number of white small parts are either the nodular, unmelted structure, whose cut cross section is shown, or atomized powder which has been finely divided into fine fragments during the transportation of flame-spraying. Fine white points in the white nodular, unmelted structure are lead phases which precipitate or crystalize in the atomized powder.

It is undesirable in the lead-segregated structure that either unmelted structure or lead-free melted structure is excessively abundant. It is therefore desirable that the unmelted structure is from 2 to 70% by area, more preferably from 2 to 50% by area. The lead phases in the unmelted structure (atomized structure) may be in the form of a network but is preferably in a particulate form, because the cracking does not propagate along the lead layer during sliding, when the lead phases are in the particulate form, so that the crack resistance is enhanced. In order for the lead phases in the unmelted structure (atomized structure) to be in a particulate form, it is necessary that: the atomized powder, whose lead phases are in the particulate form, is selected as starting material; and, further, the impinging pressure upon the blank material should not be so excessively high as to collapse the unmelted powder to such an extent that its lead phases are converted to laminar form. When the particle diameter of particulate lead-phases is too large, the strength is lowered. On the other hand, when the particle diameter is too small, the lubricating property is lowered. Desirably, the diameter is within a range of 0.5 to 20 $\mu$m, assuming that the area of the lead phases is converted to a circle.

Thickness of the flame-sprayed layer having the lead-segregated structure is preferably within a range of from 5 to 500 $\mu$m. When the thickness is too great, the desired structure is not obtained but the unmelted atomized structure undergoes melting because heat is confined in the flame-sprayed layer, unless labor-consuming measures are employed such that backing metal is subjected to forced cooling of the opposite side of flame spraying. Contrary to this, when the thickness is too small, the sliding properties are inferior. Considering both these aspects, the thickness needs to be determined appropriately. High speed fire-flame spraying, in which the gas pressure and the gas speed are set high, is employed, while the spraying distance is set at 180 mm. A condition for limiting thickness of the flame-sprayed layer is set. More specific conditions are shown in the following.

Gas pressure: 1MPa

Flame speed: 1200 m/s

Thickness of flame-sprayed layer: 250 $\mu$m

Next, the structure of bronze, to which a solid-solution type element such as aluminum is added, is described. In this structure is mixed a structure, in which the original shape of atomized powder (namely, "the atomized structure") and a structure, in which the original shape of atomized powder is changed to a laminar form or the like (hereinafter referred to as "the flame-sprayed deformed structure"). This point is the same as that of the flame-sprayed structure of copper-lead alloy described above. Points of contrast between the atomized structure and the flame-sprayed deformed structure are described. Since the atomized structure is heated during the flame-spraying and after impinging upon the swash plate, the structure is a homogenized and annealed one. On the other hand, the flame-sprayed deformed structure is a cast structure, in which the atomized powder is re-melted and solidified. Therefore, the solid solution amount of aluminum is small in the atomized structure, and the aluminum is liable to precipitate uniformly and finely. The solid-solution amount of aluminum is large in the flame-sprayed deformed structure. In addition, when the addition amount of aluminum is much less than the solid-solution amount under the equilibrium state, aluminum segregates in the case of flame-sprayed deformed structure, as seen in the cast structure, while the aluminum distribution is uniform in the atomized structure. Uniform distribution of the solute element, i.e., aluminum, always provides a contact with the surface of the opposing material, having microscopically uniform sliding properties, and is considered to be desirable in the light of sliding properties. To summarize the above description, the two aspects of the sliding properties as described in detail with respect to the copper-lead alloy are realized, although not distinctly.

Such elements as nickel, antimony, iron, aluminum, phosphorus, zinc and manganese are preferably contained in only either the melted structure or forcedly solid-dissolved flame-sprayed structure. Silver may be contained in any structure(s).

It is possible to add into copper alloys having the above mentioned various flame-sprayed structures not more than 10%, preferably from 1 to 10% of one or more compounds selected from a group consisting of $Al_2O_3$, $SiO_2$, SiC, $ZrO_2$, $Si_3N_4$, BN, AlN, TiN, TiV, $B_4C$, iron-phosphorus compound, iron-boron compound, and iron-nitrogen compound, as a component for enhancing the wear resistance. When the addition amount of these component(s) exceeds 10%, the lubricating properties and the compatibility become poor, and as a result, seizure becomes liable to occur.

Furthermore, in the present invention, the bronze can contain not more than 3% of graphite by weight percentage. Graphite is an additive agent which enhances the lubricating property and hence prevents cracks in the sliding layer of a swash plate. When the content of graphite exceeds 3%, the strength of bronze disadvantageously lowers. The preferred content of graphite is from 0.15 to 1.5%.

Figure 8:
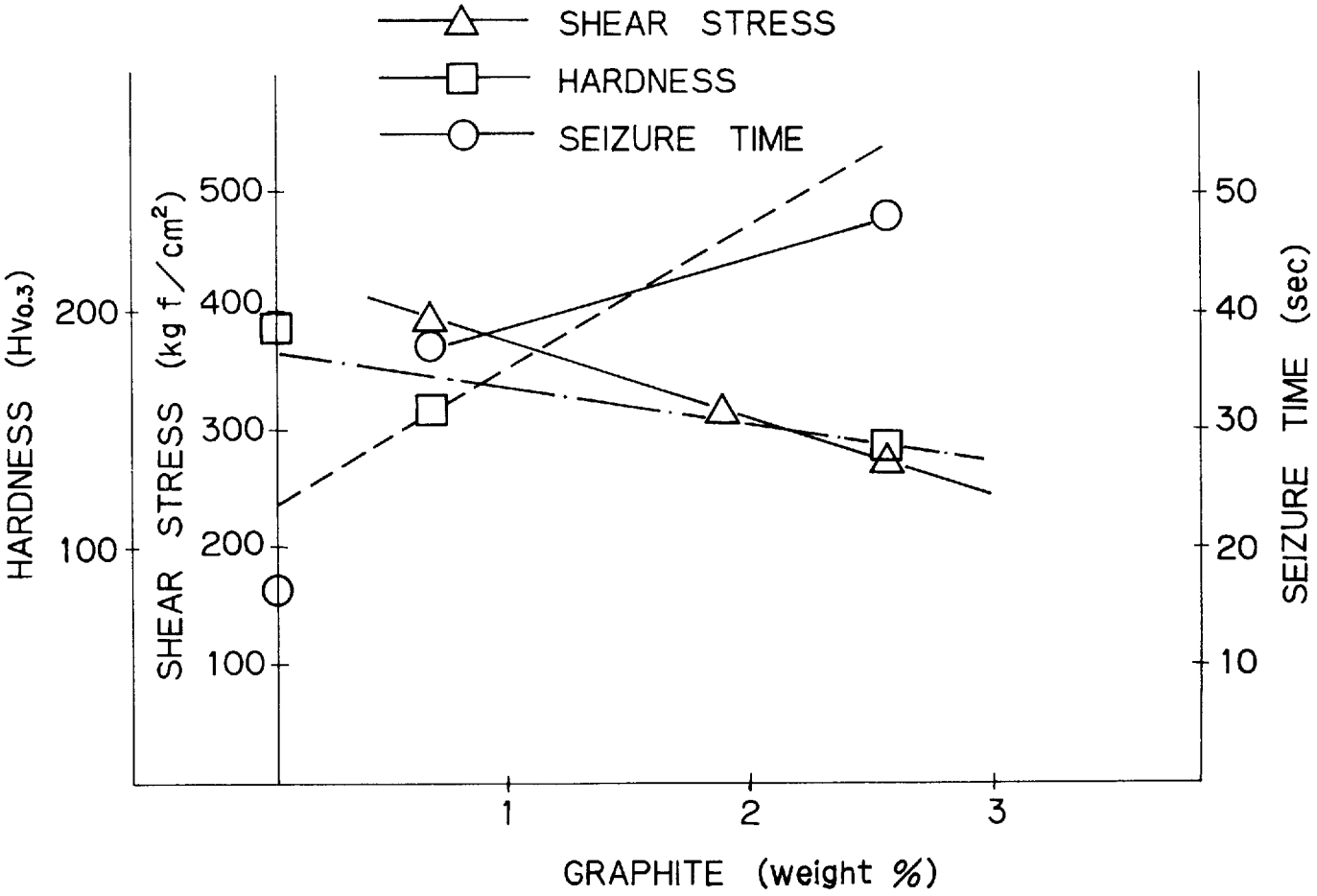
FIG. 8 is a graph showing the properties of a flame-sprayed layer with the graphite additive.

FIG. 8 is a graph showing the relationship between the amount of graphite, which is added to the flame-sprayed sliding layer (the flame-sprayed structure—lead segregated structure, thickness—200 μm) of a Cu—6% Sn alloy, and the physical properties and seizure time.

The testing conditions are as follows.

Testing machine: a pin-disc testing machine

Sliding speed: 20 m/second

Load: 500N

Lubricating oil: ice-machine oil applied at the beginning

Opposing material: Quenched SUJ2 pin

It is apparent from FIG. 8 that: the hardness (Vickers hardness under 300 g of load) and the shear stress lowers along with the addition amount of graphite, thereby impairing the basic physical properties of the flame-sprayed layer; but, on the other hand, the seizure resistance, which is one of the sliding properties, is enhanced. Such an outstanding effect is attributable to the fact that the graphite decreases the coefficient of friction. The above mentioned basic physical properties do not significantly influence the seizure under a condition which is infinitely close to the dry condition.

Since graphite, which is effective for decreasing coefficient of friction, is liable to burn during the flame spraying, a measure against the oxidation, such as copper coating, should be employed.

It is preferred in the present invention, in order to enhance the adhesion of the flame-sprayed layer, that an intermediate layer, which consists of one or more kinds of material selected from a group consisting of copper, nickel, aluminum, copper-nickel based alloy, nickel-aluminum based alloy, copper-aluminum based alloy, copper-tin based alloy, self-fluxing nickel alloy, and self-fluxing cobalt alloy, is formed between the flame-sprayed layer and the substrate of a swash plate by means of a method such as sputtering, flame-spraying or the like. Any one of these materials is easily alloyed with the bronze and is therefore strongly bonded with the (un)melted layer during the flame spraying. The bonding strength between the flame-sprayed layer and the backing metal, is enhanced, when the surface of materials is rough. A preferred thickness of the intermediate layer is from 5 to 100 μm. As the copper-tin based alloy, a Cu—Sn—P based alloy can be used. This alloy has good fluidity and does not oxidize easily and hence can provide improved performances, when it is flame-sprayed to form an intermediate layer.

The sliding layer according to the present invention can be produced by the ordinary flame-spraying method and under the ordinary condition. However, when the flame-sprayed structure with the mixed, melted and unmelted structures is to be formed, the flame-spraying conditions must be that: only part of the atomized bronze powder is melted during the transportation of flame-spraying; after impinging upon the backing metal, the entire lead-bronze is not remelted (a partial remelting may occur); and, the cooling speed of the melted alloy and solidified alloy is fast. More specifically, the high-speed fire-flame spraying method is employed, in which gas-pressure and gas-speed are made high, while the flame-spraying distance is set at 180 mm, thereby providing a condition for limiting the thickness of the flame-sprayed layer. More specified conditions are as follows.

Gas pressure: 1MPa

Flame speed: 1200 m/sec

Thickness of flame-sprayed layer: 250 μm

In order to increase the proportion of atomized structure under the above mentioned conditions, the proportion of powder to gas may be increased. Optional proportion of the structure can be adjusted by adjusting the spraying conditions.

Next, a method for producing a lead-segregated structure is described.

It is indicated in the metal (copper)/ceramics($Al_2O_3$) based flame-spraying that the latter is once melted, then separated from the former and is solidified (Bulletin of The Japan Institute of Metals. "Materia" Vol. 33 (1994), No.3, page 271, FIG. 5). Such separation and solidification is virtually impossible in the copper-lead based powder because of the low melting point of lead. On the other hand, the possibility of lead melting during flame spraying is higher than that of copper.

Consideration was given to the flame-spraying conditions, under which the above points are avoided, whereby the complete melting of the lead-containing powder with coarse grains does not occur but melting of the lead-free powder with fine grains occurs during the transportation of flame-spraying and the above mentioned powder with coarse grains does not melt after impinging on the backing metal. As a result, it turned out that an advisable flame-spraying condition lies in the first powder with fine grains, which is fine powder essentially not containing lead and is mainly composed of copper, and, further in the second powder with coarse grains, which contains lead and is mainly composed of copper. Preferably, a high-speed fire-flame spraying method is employed, in which gas-pressure and gas-speed are made high, while the flame-spraying distance is set at 180 mm, thereby providing a condition for limiting the thickness of a flame-sprayed layer. More specified conditions are as follows.

Gas pressure: 1MPa

Flame speed: 1200 m/sec

Thickness of flame-sprayed layer: 250 μm

The coarse grains and fine grains here indicate that there is a difference of two or more grades in the average grain diameter according to JIS Z 8801 (amended in 1981, standard mesh opening). When the difference in grades is only one, the melting of lead is liable to occur. A difference in grade of eight or less is preferable from the viewpoint of the strength of bond of flame-sprayed layer.

In addition, the first and second powder must be mainly composed of copper from the viewpoint of the sliding properties. On the other hand, when powder of a metallic element, such as lead, tin and the like is flame-sprayed, there is a danger that a region with poor sliding properties may be formed in the flame-sprayed layer. Incidentally, as to a specific powder, in which tin or the like should be contained, one should follow the descriptions hereinabove directed to the additive elements into the melted structure and the unmelted structure.

The physical properties of the flame-sprayed layer are now described.

Hardness of the flame-sprayed layer is mainly dependent upon the amount of the additive element(s) and is in the range of $Hv_{(0.3)}$ 110–280 when the addition amount is in the range of 0.5 to 40%. This high hardness of the flame-sprayed layer is characteristic as compared with that of sintered material and cast material.

Thickness of the flame-sprayed layer is preferably from 5 to 500 μm. When the thickness exceeds 500 μm, amount of heat confined in the flame-sprayed layer becomes great. When the calorie is more than a certain level, the copper alloy may be remelted, so that the hardness and density are lowered. As a result, the sliding properties are impaired. Preferred thickness of the flame-sprayed layer is from 5 to 300 μm, particularly, from 20 to 200 μm.

After flame-spraying, the surface of the flame-sprayed layer may be or may not be polished, and the above mentioned thickness is attained to provide the sliding layer.

The surface of a swash plate may be subjected to roughening treatment, such as shot blasting, etching, chemical conversion treatment and the like, or may be subjected to plating. These treatments can be optionally applied.

In addition, in the present invention, the heat treatment may be carried out under a condition to attain the homogenlity of the components in the flame-sprayed layer. More specifically, the copper-based alloy having the above mentioned composition, if necessary together with the hard matters, is flame sprayed, and, subsequently, to this flame-sprayed layer heat treatment can be applied in a temperature range from 100° to 300° C. for 30 to 240 minutes. When the temperature and time are less than these lower limits, the heat treatment is not effective to homogenize the components. On the other hand, when the temperature and time exceed the above upper limits, the flame-sprayed layer softens, or the crystal grains, of which the above mentioned structures such as the atomized structure and the flame-sprayed deformed structure are comprised, the lead particles, and flaky structure are caused and, hence the peculiar morphology of the flame-sprayed structure may be destroyed and the sliding properties are impaired. Preferred conditions for heat treatment are 150°–300° C. for 10 to 120 minutes, more preferably 150°–250° C. for 60°–120 minutes.

In addition in the present invention, the flame-sprayed layer may be subjected to peening (which is occasionally referred to as shot blasting) so as to prevent the cross cracks from occurring on a swash plate. The peening may be preferably carried out such that the grains of steel, zinc or the like having a particle diameter of from approximately 0.05 to 1.0 mm are projected under a condition of 0.1–0.8 MPa and speed of 10 to 80 m/second.

Figure 9:
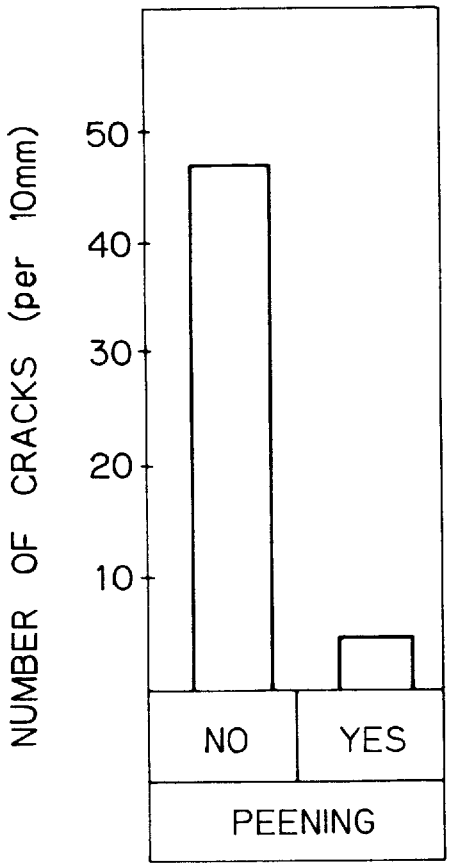
FIG. 9 is a graph showing the effect of peening in preventing cross cracks.

FIG. 9 is a graph showing the results of such tests where the resistance against the surface cracking is measured by a seizure-testing method. The number of surface cracks generated by this testing method is measured for each case of peening and without peening. The powder used was 30% by weight of the following (a) and 70% by weight of the following (b).

(a) Cu—10% Pb—10% Sn, average particle diameter of 63 μm.

(b) Cu—6% Sn, average particle diameter of 19 μm.

The flame-sprayed layer has a structure of lead-segregated structure and a thickness of 200 μm. As is apparent from FIG. 9, the peening is very effective for preventing the cross cracks.

Preferred peening conditions are described with reference to FIG. 10 and FIG. 11.

Flame spraying of Cu—10% Pb—10% Sn alloy with 300 μm thickness (structure as shown in FIG. 5) was applied on a substrate (SPCC) having 1.5 mm of thickness and 40 mm of width. After flame spraying, the samples were deflected so that the substrate side was concave. The deflection amount (d) was thus measured. Subsequently, the peening was carried out by the iron balls as shown in FIG. 10. The deformation amount in terms of deflection amount (d) is indicated in the graph of said drawing. As is apparent from this drawing, the peening effect is appreciable at approximately 10 seconds or later. Considering the size difference in an actual swash-plate and the samples, preferred peening on an actual swash-plate is believed to be approximately 50 seconds or more.

Figure 10:
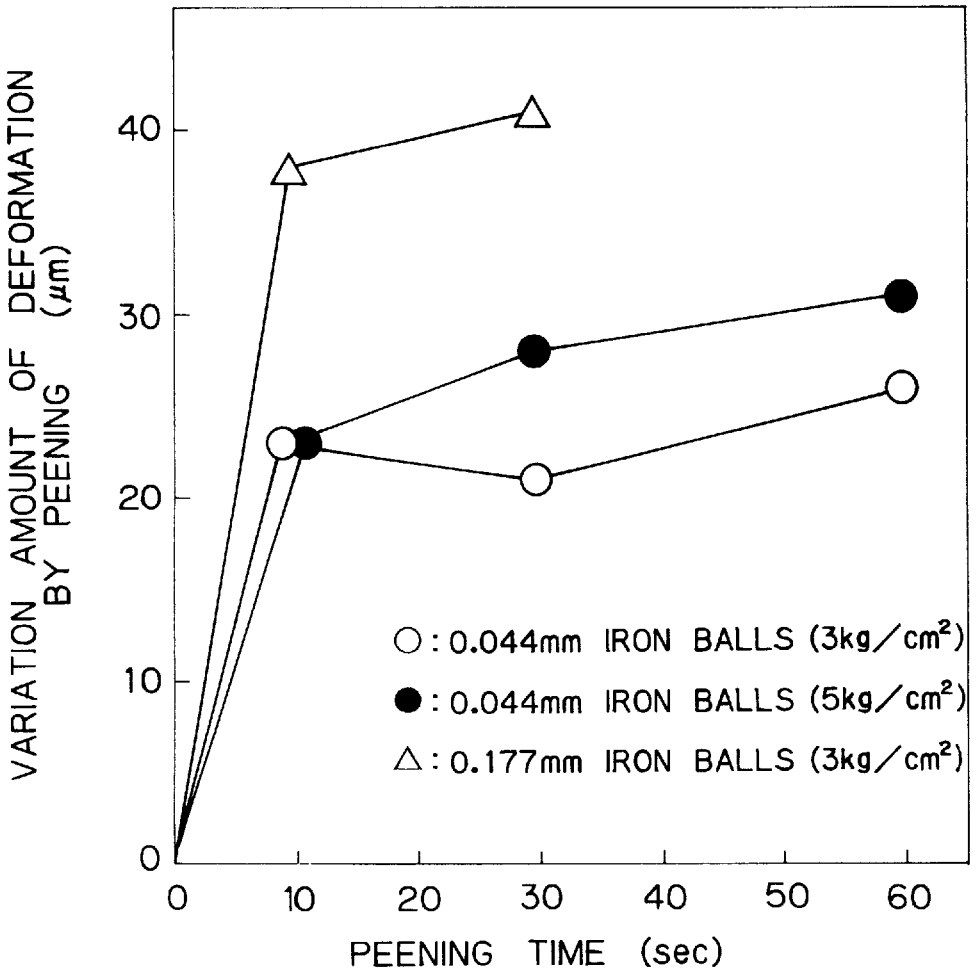
FIG. 10 is a graph showing amount of deformation due to peening by iron balls.
Figure 11:
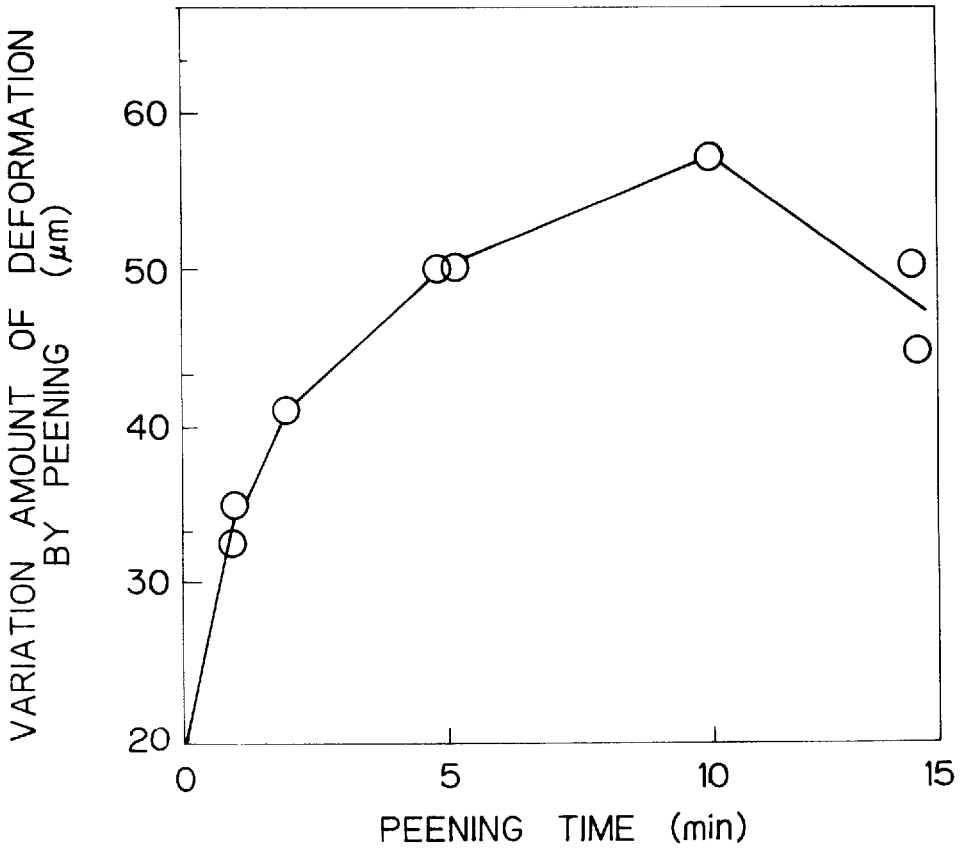
FIG. 11 is a graph showing amount of deformation due to peening by zinc balls.

FIG. 11 shows the result of the same flame-spraying and peening as in FIG. 10 except for 0.5 mm zinc balls and 0.2 MPa in peening. As is apparent from this drawing, the peening effect is appreciable from approximately 1 minute in the case of zinc balls. Time of zinc-ball peening on a swash plate is believed to be preferably 5 minutes or more.

In Table 1 is shown the change of stress in a flame-sprayed layer, in a case where the Cu—10% Pb—10% Sn alloy is flame-sprayed on an aluminum-substrate to a thickness of 200 μm (the structure as shown in FIG. 5) and is subsequently subjected to heat treatment or peening.

TABLE 1

| Condition | Stress (MPa) |
|---|---|
| After flame spraying | +30 |
| Heat treatment | |
| 200° C. × 1 hr | +30 |
| 200° C. × 3 hr | +30 |
| Peening | −50 |

As is apparent from this table, the tension stress is mitigated by applying peening on the flame-sprayed layer and is converted to compression stress. This is believed to make the surface cracking difficult to occur. Contrary to this, the heat treatment does not change the internal stress.

The present invention is hereinafter more specifically described with regard to the examples.

Example 1

Water-atomized lead-bronze powder having the following qualities were flame-sprayed on a disc plate (SCM 415 (quenched), thickness 10 mm) to form a flame-sprayed layer having a thickness of from 100 to 150 μm.

Lead content: 10%

Tin content: 10%

Particle diameter: under 75 μm

Structure: shown in FIG. 3

The flame-spraying was carried out by using a diamond-jet type gun produced by FIRST METECO Co., Ltd., and under the following conditions. The structure of the resultant flame-sprayed layer is 25% by area of the unmelted atomized powder and the balance of the melted structure.

Kind of gas: Mixed gases of propylene in 10 volume parts and air in 90 volume parts.

Pressure of gas: 0.69 MPa

Flame speed: 1200 m/sec

Flame-spraying distance: 180 mm

Supplying amount of powder: 50 g/minute

The seizure resistance was tested under the following conditions.

Seizure Test

Testing machine: Pin-disc type testing machine

Sliding speed: 15 m/s

Lubricating condition: Ice-machine oil

Appllication method of load: 400N/10 minutes, successive increase

Opposing material (pin): quenched SUJ2

Incidentally, for comparison purposes, a round disc brazed with sintered copper-alloy (hardness, Hv approximately 90) and an aluminum round-disc were also tested.

Figure 12:
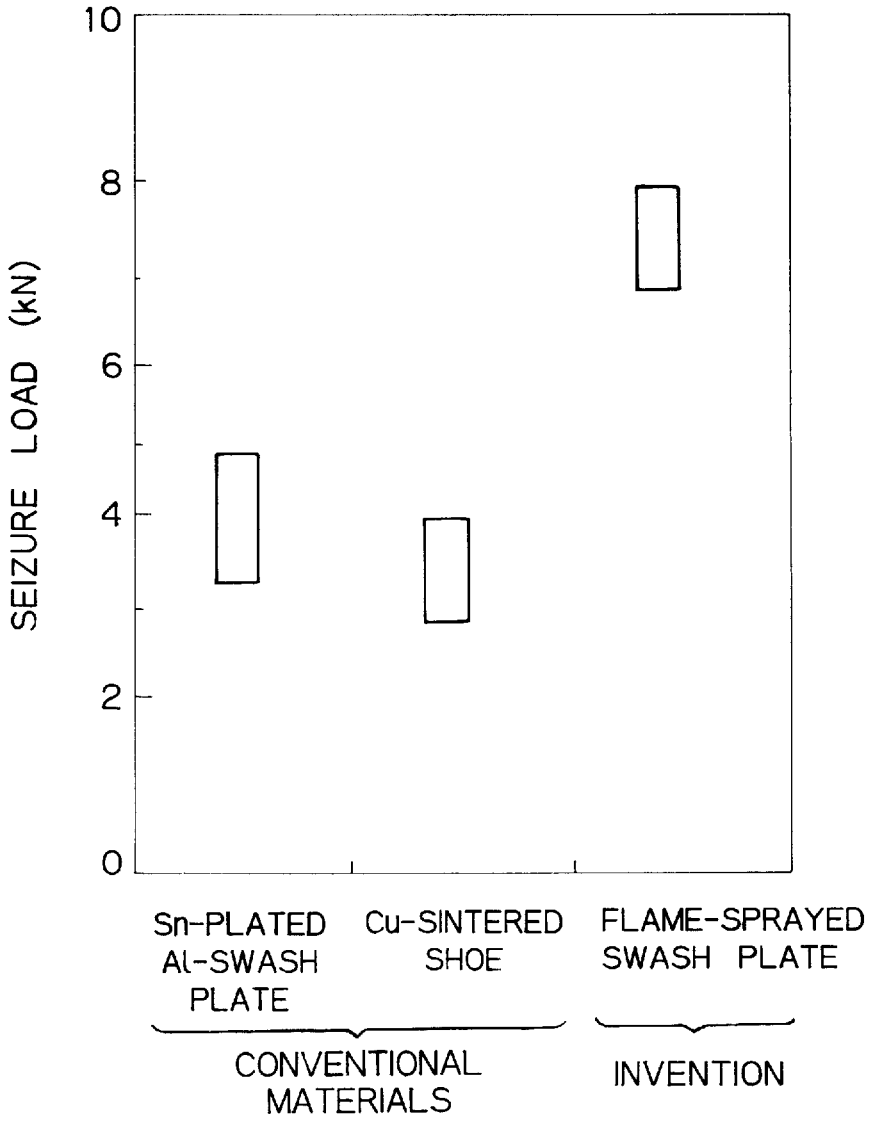
FIG. 12 is a graph showing the seizure resistance of various swash plates.

The results of the test are shown in FIG. 12. It is clear from FIG. 12 that the swash plate according to the present invention exhibits seizure resistance twice or more superior to the comparative materials.

Example 2

An aluminum-alloy (Alusil alloy) swash plate and a flame-sprayed swash plate according to the inventive Example 1 were mounted in a commercially available swash-plate type compressor and subjected to a bench test. The results of the test are shown in the following table.

TABLE 2

| Condition | Aluminum swash-plate | Flame-sprayed swash-plate |
|---|---|---|
| Low speed, high-pressure test (700 rpm, 2.46 MPa, 120° C.) | Wear | Neither seizure, wear nor peeling. clearing 900 hours |
| High-speed, high-pressure test (6000 rpm, 2.96 MPa, 120° C.) | Seizure | Neither seizure, wear nor peeling. clearing 100 hours |

Example 3

The composition of the flame-sprayed materials was varied as shown in Table 3. The flame-sprayed structure was adjusted to be either the totally melted structure or partially melted structure (i.e., partially atomized structure). In several samples, a 100 μm thick intermediate layer of Cu—6% Sn—0.3% P alloy was formed. The flame-spraying condition was that 40 g/minute of powder-supplying amount for the case of "the total melting" (the totally melted structure). The flame condition is the same as in Example 1 for the other cases. The results of the seizure test are shown in Table 3.

TABLE 3

| Sample | Composition (wt %) of Flame-sprayed Layer | | | | | Fe—P hard | Intermediate | Structure | Seizure load |
|---|---|---|---|---|---|---|---|---|---|
| No. | Cu | Sn | Pb | Ag | Others | matters | layer | | (kN) |
| 1 | bal | 10 | — | — | — | — | no | unmelted + melted | 6.0 |
| 2 | bal | — | 10 | — | — | — | no | totally melted | 6.4 |
| 3 | bal | 10 | 10 | — | — | — | yes | unmelted + melted | 8.0 |
| 4 | bal | 10 | 10 | — | — | — | no | unmelted + melted | 8.0 |
| 5 | bal | 10 | 10 | — | — | 2 | no | unmelted + melted | 7.6 |
| 6 | bal | — | — | 7 | — | — | no | unmelted + melted | 8.0 |
| 7 | bal | 6 | — | — | P = 0.3 | — | no | unmelted + melted | 7.2 |
| 8 | bal | 10 | 5 | — | — | — | yes | unmelted + melted | 6.8 |
| 9 | bal | — | — | 1 | Ni = 1 | — | no | unmelted + melted | 8.8 |

The seizure load of the aluminum cast material (Al—17% Si—4% Cu) and sintered copper material (Cu—10% Pb—10% Sn) tested for the comparison purpose was 4.OkN and 6.0 kN, respectively.

10% of Sn of Sample No. 1 was replaced with either of 0.4% of P, 5% of Al, 1% of Si, 2% of Mn, 2% of Cr. 3% of Ni or 15% of Zn. A virtually identical seizure load was obtained. Furthermore, Fe—B compound or Fe—N compound was replaced for the Fe—P compound of Sample No. 5. Even using the former compounds, the same seizure performance was obtained in the samples with addition of any one of these elements.

Example 4

Water-atomized bronze powder having the following qualities was used to spray on a steel sheet (SPCC, thickness 1.5 mm).

Lead content: 8%

Particle diameter: under 90 μm

Structure: shown in FIG. 7

The flame spraying was carried out using a diamond-jet type gun produced by FIRST METECO Co., Ltd., under the conditions mentioned below.

Figure 13A:
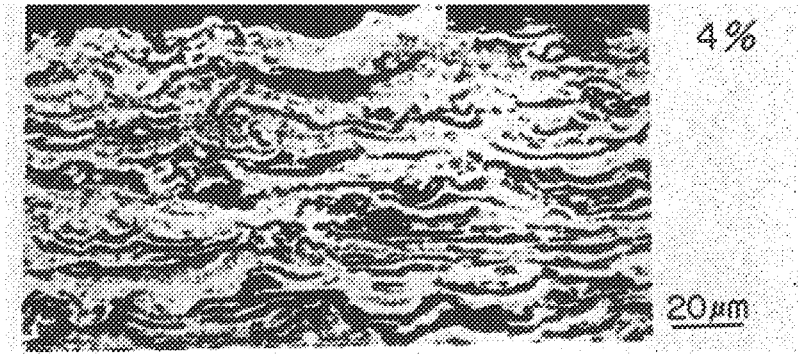
FIG. 13 is photographs showing metal microscopic structure of the flame-sprayed layer and atomized powder in Example 4.
Figure 13B:
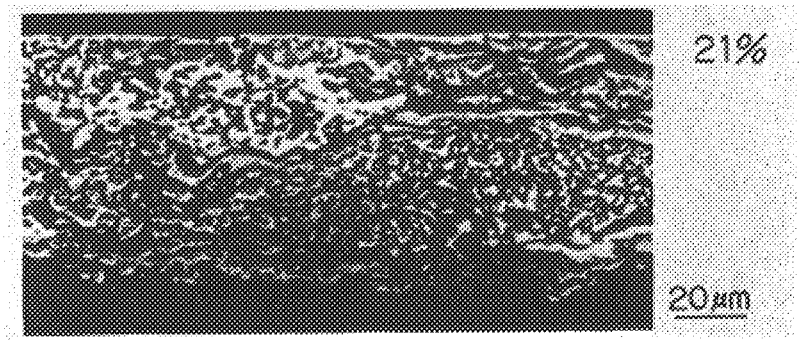
Figure 13C:
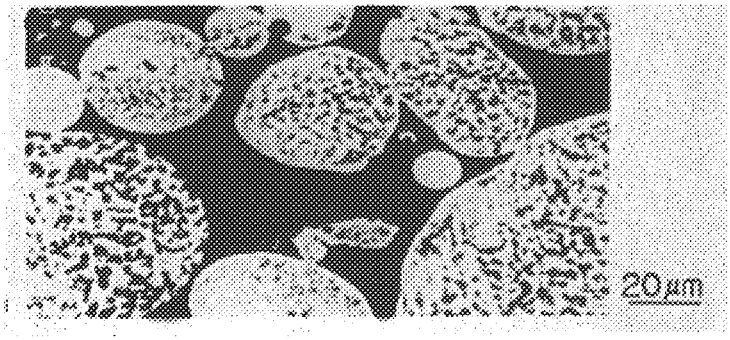

Kind of gas: mixed gases of propylene in 10 parts by volume and air, in 90 parts by volume Gas pressure: 0.69 MPa Flame speed: 1200 m/s Flame spraying distance: 180 mm Powder supplying amount: 30–100 g/minute The powder charging amount was adjusted within the above mentioned range so as to vary the proportion of atomized structure in 4% by area, 21% by area, and 40% by area. In FIG. 13 are shown the structure photographs of the cross section of the flame-sprayed layer with 4% by area and 21% by area of the atomized structure, observed by an electron microscope.

The flame-sprayed layers obtained by the above mentioned method had a thickness of approximately 100 μm and a lead content of 8%. Hardness values were measured at optional thirty positions of the flame-sprayed layer. The obtained average hardness was Hv 205.

For comparison purposes, the bronze layers were produced by the sintered material having the same composition and thickness as in the inventive example. Their seizure resistance and wear resistance were tested under the following conditions.

Seizure Test

Testing machine: pin-disc tester

Sliding speed: 15 m/s

Lubricating condition: dropwise

Method for applying load: Successive increase of load

Opposing material: bearing steel

Wear Test

Testing machine: pin-disc tester

Sliding speed: 3 m/s

Lubricating condition: in cooling medium with the addition of ice machine oil

Load: 0.4 kN

Opposing material: quenched bearing steel

The test results are shown by the wear amount relative to the load x sliding distance.

Figure 14:
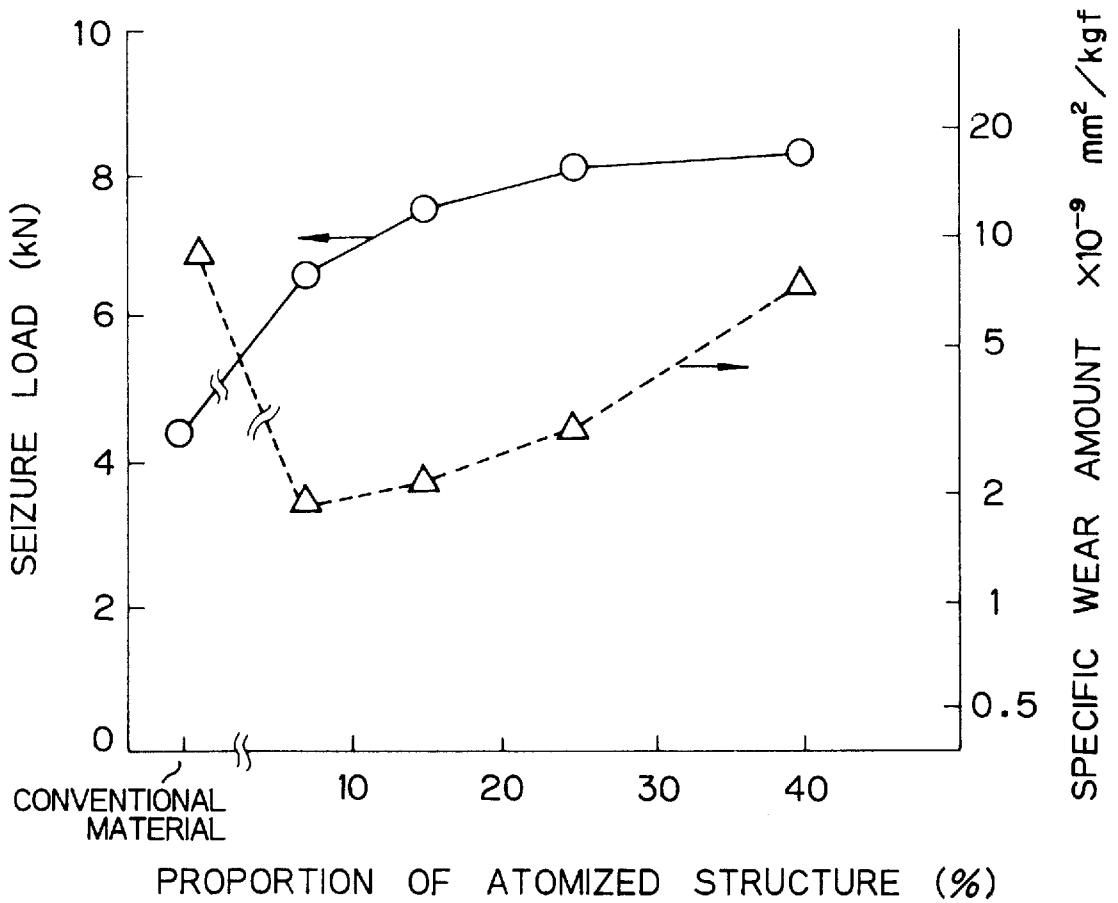
FIG. 14 is a graph showing the relationship between the structure of a flame-sprayed layer, and the physical properties of the flame-sprayed layer.

It is clear from FIG. 14 showing the test results that the bearing material according to the present invention is superior to the conventional material in both seizure resistance and wear resistance.

Example 5

The same test as in Example 1 was carried out except that lead-tin bronze powder containing 10% of tin was used and the structure with a proportion of atomized structure being 22% by area. Then the seizure load was 8 kN and the specific wear amount was $1.5\times10^{-9}$ Example 6

The powder, to which the hard matters were added as in Table 4, was flame-sprayed, and the tests were carried out. The results obtained are shown in Table 4.

TABLE 4

| | Composition (Wt %) | | | | | Flame sprayed structure Atomized structure (%) | Sliding Properties: Seizure Load (kN) | Sliding Properties: Specific Wear Amount ($10^{-10}mm^2/N$) |
|---|---|---|---|---|---|---|---|---|
| No. | Cu | Pb | Sn | Ag | Additive agent | | | |
| 1 | bal | 7 | — | — | $Fe_3P$ = 2 | 20 | 6.7 | 2.0 |
| 2 | bal | 7 | — | — | $Al_2O_3$ = 1<br>$SiO_2$ = 1<br>$ZrO_2$ = 1 | 20 | 6.4 | 1.5 |
| 3 | bal | 7 | — | — | $Si_3N_4$ = 1<br>TiN = 2 | 20 | 6.5 | 1.8 |
| 4 | bal | 7 | — | — | SiC = 1<br>$B_4C$ = 1<br>TiC = 1 | 20 | 6.2 | 1.5 |
| 5 | bal | 10 | 10 | — | — | 22 | 8.0 | 1.5 |
| 6 | bal | 10 | 10 | 1 | — | 15 | 8.0 | 1.7 |
| 7 | bal | 10 | 10 | — | Graphite = 2 | 19 | 8.1 | |
| 8 | bal | 10 | 10 | — | $Fe_3N$ = 1<br>$Fe_2B$ = 1 | 18 | 7.3 | 1.1 |
| 9 | bal | 10 | 10 | — | AlN = 3 | 15 | 7.7 | 0.8 |
| 10 | bal | 10 | 10 | — | $Fe_3P$ = 8 | 15 | 7.4 | 0.8 |

When Table 4 and FIG. 14 are compared, it is clear that the wear resistance is improved by the addition of hard matters, while the seizure resistance is virtually unaffected by the addition of hard matters.

Example 7 (an example of the lead-segregated structure)

Shot blasting was carried out by using alumina grids on a steel sheet (SPCC, thickness—5 mm) so as to roughen the surface. On this surface the Ni—5% Al powder was flame-sprayed under the following conditions.

Diamond-jet type gun of FIRST METECO Co., Ltd.

Kind of gas: mixed gases of propylene in 10 parts by volume

When Table 4 and FIG. 14 are compared, it is clear that the wear resistance is improved by the addition of hard matters, Gas pressure: 0.69 MPa Flame speed: 1200 m/sec Gas rate: 80 liter/minute Flame-spraying distance: 180 mm Powder supplying amount: 30–60 g/minute On the flame-sprayed Ni—5% Al intermediate layer, the atomized bronze powder having the following qualities was flame-sprayed under the condition below.

a: Cu—3.5% Sn—23% Pb (average particle diameter 63 $\mu$m)

b: Cu—6% Sn (average particle diameter—19 $\mu$m)

Diamond-jet type gun of FIRST METECO Co., Ltd.

Kind of gas: mixed gases of propylene in 10 parts by volume and air, in 90 parts by volume Gas pressure: 0.69 MPa Flame speed: 1200 m/s Gas rate: 60 liter/minute Flame-spraying distance: 180 mm Powder supplying amount: 30–100 g/minute Blending proportion of powder: a-30%; b-70%

The flame-sprayed layer obtained by the above method had a thickness of approximately 100 $\mu$m and 8% of lead content. Hardness of optional thirty positions of the flame-sprayed layer was measured, and the obtained average hardness was Hv 180.

Test of Strength of Bond

Figure 15:
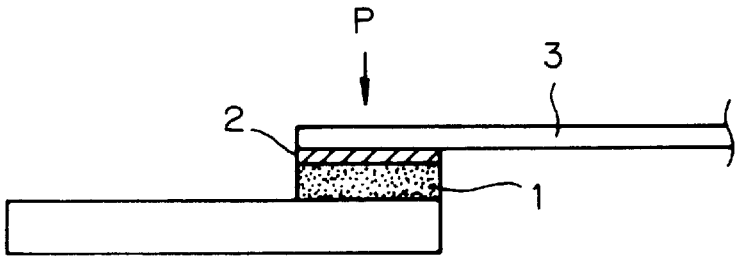
FIG. 15 is a drawing describing a test for the force of bonding.

Bonding test by adhesive agent (shown FIG. 15)

Adhesive agent: epoxy-based adhesive agent (the adhesive agent-layer 2 was bonded on the lower side of the sheet)

Flame-sprayed layer: thickness—150 $\mu$m (denoted as 1 in FIG. 1)

Rod 3 was horizontally pulled off.

Seizure test

Figure 16:
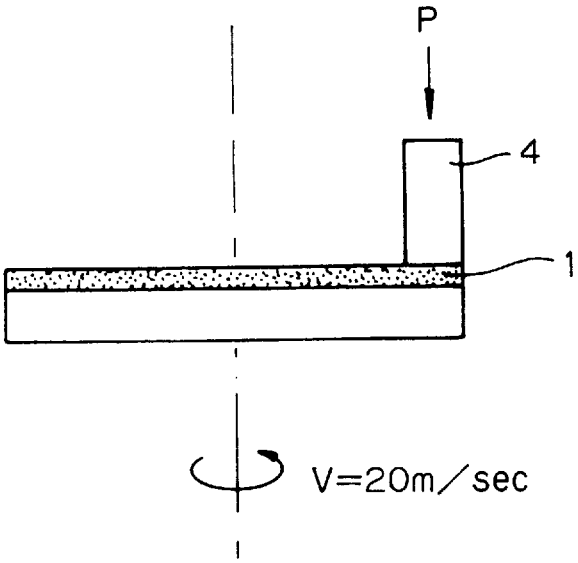
FIG. 16 is a drawing describing a test for the seizure resistance.

Oil-cut seizure test (shown in FIG. 16)

Sliding speed: 20 m/s

Lubricating condition: application of oil prior to test

Load: 0.5 kN

Opposing material: SUJ2 (denoted in FIG. 16 as 4)

Figure 17:
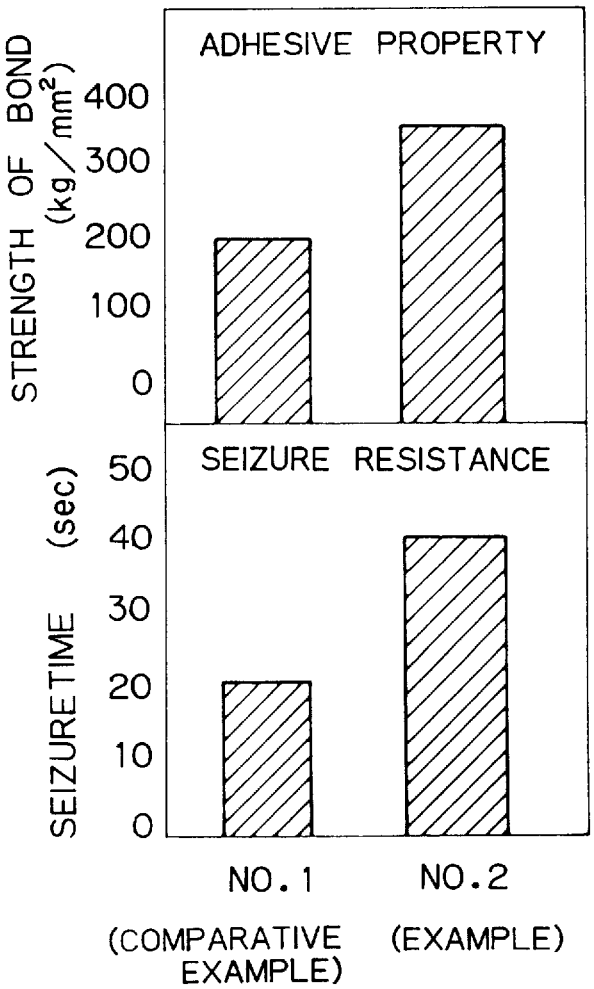
FIG. 17 is graphs describing the test results.

The test results are shown in FIG. 17. It is clear from FIG. 17 that the inventive bearing material is superior to the conventional material in both points of bonding property and seizure resistance.

Example 8 (Example of lead-segregated structure)

The same test as in Example 7 was carried out except that the conditions were changed as in Table 5. The results shown in Table 5 were obtained. In Table 5, the comparative material 14 is an example with a high Pb content, the comparative material No. 15 is an example with a low Pb content, the comparative material No. 16 is an example with the totally melted structure, and the comparative material No. 17 is an example with only one kind of powder used. Each of them is a comparative example with respect to the lead-segregated structure.

TABLE 5

| | Flame-sprayed materials No. | Powder μm | Average-particle diameler | Powder composition wt % Cu | Pb | Sn | others | Additive material | Mixing proportion % | Inter-mediate layer | Shear-stress kgf/cm$^2$ | Sliding Properties seizure time sec |
|---|---|---|---|---|---|---|---|---|---|---|---|---|
| Inventive Materials | 1 | a | 60 | Bal. | 23 | 3.5 | P = 0.2 | — | 70 | Ni—5Al | 290 | 40 |
| | | b | 25 | Bal. | | 6 | | | 30 | | | |
| | 2 | a | 60 | Bal. | 23 | 3.5 | Ag = 1 | — | 70 | Ni—5Al | 270 | 42 |
| | | b | 30 | Bal. | | 2 | | | 30 | | | |
| | 3 | a | 60 | Bal. | 23 | 3.5 | P = 0.2 | — | 50 | Ni—5Al | 340 | 35 |
| | | b | 25 | Bal. | | 6 | | | 50 | | | |
| | 4 | a | 60 | Bal. | 23 | 3.5 | P = 0.2 | — | 40 | Ni—5Al | >380 | 33 |
| | | b | 25 | Bal. | | 6 | | | 60 | | | |
| | 5 | a | 60 | Bal. | 23 | 3.5 | P = 0.2 | — | 30 | Ni—5Al | >380 | 27 |
| | | b | 25 | Bal. | | 6 | | | 70 | | | |
| | 6 | a | 60 | Bal. | 23 | 3.5 | Ag = 1 | Fe—P | 48 | Ni—5Al | 340 | 31 |
| | | b | 25 | Bal. | | 2 | | | 48 | | | |
| | | c | 40 | | | | | | 4 | | | |
| | 7 | a | 60 | Bal. | 23 | 3.5 | P = 0.2 | Fe—B | 48 | Ni—5Al | 330 | 30 |
| | | b | 25 | Bal. | | 6 | | | 48 | | | |
| | | c | 55 | | | | | | 4 | | | |
| | 8 | a | 60 | Bal. | 23 | 3.5 | P = 0.2 | Fe—N | 48 | Ni—5Al | 330 | 30 |
| | | b | 25 | Bal. | | 6 | | | 48 | | | |
| | | c | 35 | | | | | | 4 | | | |
| | 9 | a | 60 | Bal. | 23 | 3.5 | — | Graphite | 10 | Ni—5Al | 280 | 35 |
| | | b | 25 | Bal. | | 10 | | | 85 | | | |
| | | c | 30 | | | | | | 5 | | | |
| | 10 | a | 60 | Bal. | 23 | 3.5 | Ni = 20 | — | 50 | Ni—5Al | 360 | 25 |
| | | b | 20 | Bal. | | | | | 50 | | | |
| Inventive Materials | 11 | a | 60 | Bal. | 10 | 10 | P = 0.2 | — | 70 | Cu-20 Ni | 305 | 32 |
| | | b | 25 | Bal. | | 6 | | | 30 | | | |
| | 12 | a | 60 | Bal. | 10 | 10 | P = 0.2 | — | 30 | Cu-20 Ni | 360 | 26 |
| | | b | 25 | Bal. | | 6 | | | 70 | | | |
| | 13 | a | 70 | Bal. | 35 | 5 | — | — | 30 | Cu-20 Ni | 220 | 42 |
| | | b | 20 | Bal. | 2 | 10 | | | 70 | | | |
| Comparative Materials | 14 | a | 60 | Bal. | 50 | 5 | — | — | 80 | — | 125 | 30 |
| | | b | 25 | Bal. | 5 | 10 | | | 20 | | | |
| | 15 | a | 60 | Bal. | 10 | 5 | P = 0.2 | — | 5 | Cu-20 Ni | >380 | 6 |
| | | b | 25 | Bal. | | 6 | | | 95 | | | |
| | 16 | a | 25 | Bal. | 23 | 3.5 | P = 0.2 | — | 50 | Cu-20 Ni | 200 | 18 |
| | | b | 25 | Bal. | | 6 | | | 50 | | | |
| | 17 | a | 50 | Bal. | 23 | 3.5 | — | — | 100 | Cu-20 Ni | 185 | 21 |

Example 9 (example of using an intermediate layer)

A Cu—10Pb—10Sn powder was flame-sprayed under the same condition as in Example 7. The following powder was used as the intermediate layer.

①PBP2 (Cu—6%Sn—0.2%P)

②NiAl (Ni—5% Al)

③Ni:Al (95:5)

Note that a 50 μm thick Ni—Al alloy intermediate layer was preliminarily flame-sprayed on a round disc of the substrate. The seizure-resistance test was subsequently carried out by the method described with reference to FIG. 17. The result is shown in FIG. 18.

Figure 18:
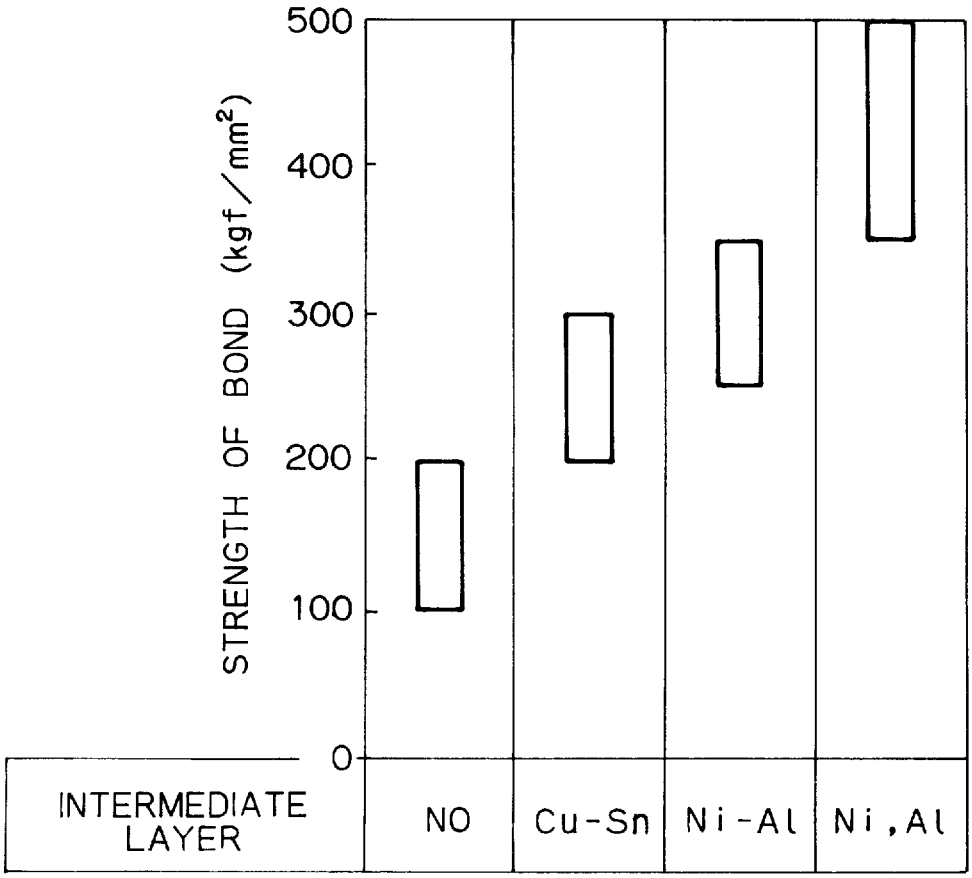
FIG. 18 is a graph showing the test results of seizure resistance in Example 9.

As is apparent from FIG. 18, the intermediate layer is effective for enhancing the strength of bond.

Example 10 (example of graphite addition)

The following powder was flame-sprayed under the same conditions as in Example 1.

① Cu—10% Ag

② Cu—1% Ag—10% Sn (average particle-diameter-45 μm, 97%) +graphite (average particle-diameter-75 μm or less, 3%)

Figure 19:
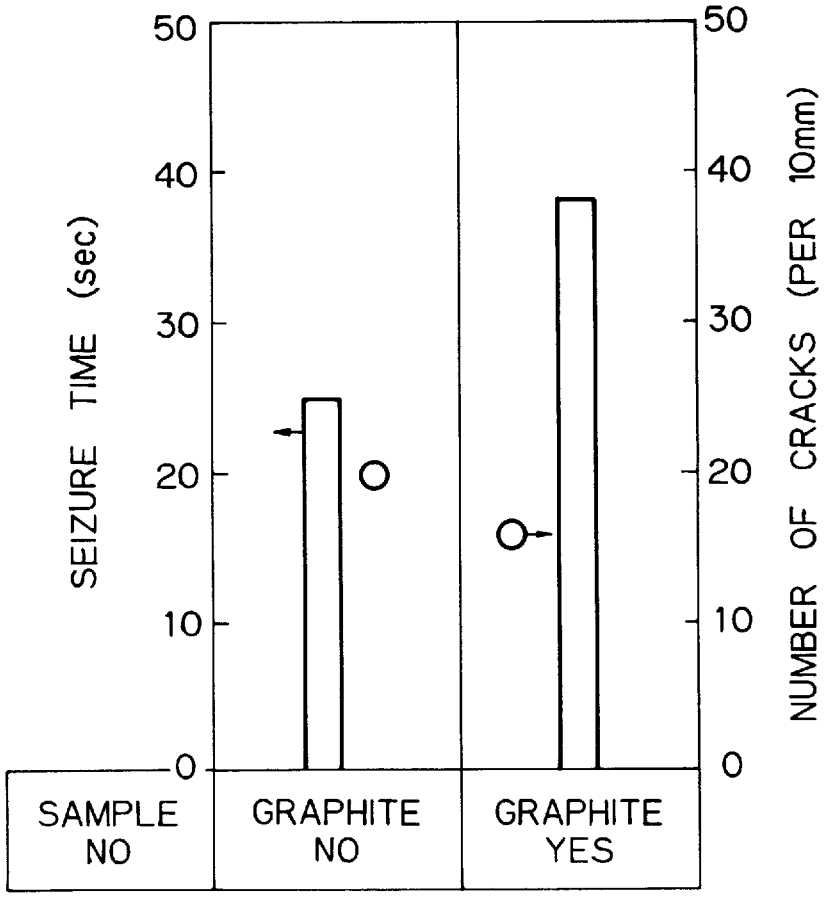
FIG. 19 is a graph showing the test results of seizure resistance and resistance against cross cracks in Example 10.

The same seizure-resistance test as in Example 9 was carried out and the number of cracks was measured. The results are shown in FIG. 19. It is clear from FIG. 19 that the graphite addition 2 is effective for preventing the cross cracks and enhances the seizure resistance.

Figures 20A, 20B, 20C:
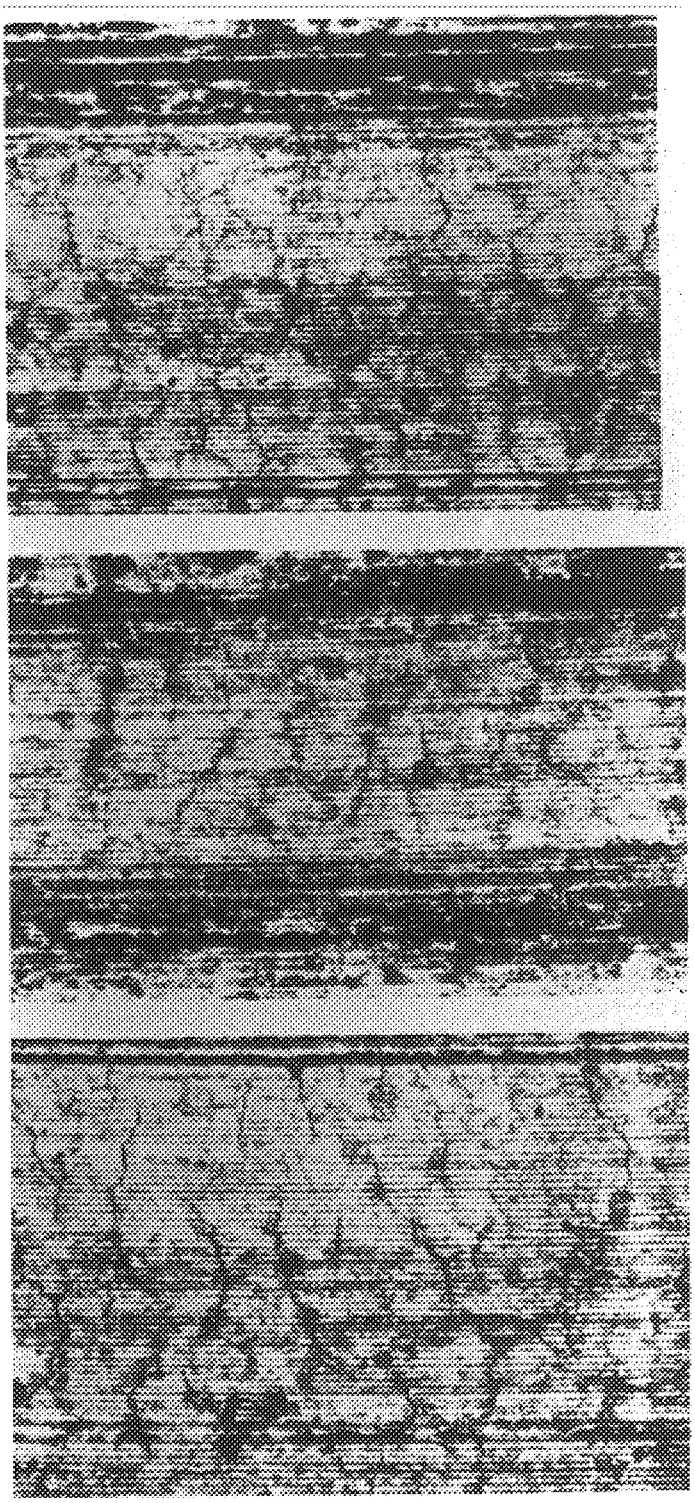
FIG. 20 is metal micro structure photographs of flame-sprayed layers on which the cross cracks are formed (magnified 20 times).

In FIG. 20 are shown the structure photographs of the flame-sprayed layer, in which the cross cracks are generated. The cross cracks shown are suppressed by eliminating fine particles. This is related to the fact that continuous lead phases are lessened. On the other hand, the cross cracks are suppressed by the graphite addition, which is related to suppressing rise in the coefficient of friction and hence rupture at locations other than the lead phases. When these measures are used in combination, the cross cracks become less likely to occur.

Industrial Applicability

As is described hereinabove, the sliding properties, which are considerably superior to the conventional swash-plate compressor, are realized by combining the features of the copper-based material and the flame-spraying. Therefore, the present invention enhances the durability and reliability of a swash plate which is exposed under severe load and lubricating condition. The present invention attains a very advantageous industrial effects.

We claim:

1. A swash plate, which consists of an iron-based or aluminum-based material and is used in a swash-plate type compressor, is characterized in that a flame-sprayed copper-based alloy, which contains in total, by weight percentage, not less than 0.5% of one or more kind selected from a group consisting of not more than 40% of lead, not more than 30% of tin, not more than 0.5% of phosphorus, not more than 15% of aluminum, not more than 10% of silver, not more than 5% of silicon, not more than 5% of manganese, not more than 5% of chromium, not more than 20% of nickel, and not more than 30% of zinc, provided that when more than one kind is present, the total is not more than 50%,. balance essentially consisting of copper and impurities, is formed on at least a sliding surface with a shoe, and has a structure including an unmelted structure of an atomized copper alloy powder.

2. A swash plate of a swash-plate type compressor according to claim 1, characterized in that the flame-sprayed layer consists of a copper-based alloy containing from 2 to 30% by weight of lead and essentially consists of a mixed structure of an unmelted structure of an atomized copper-alloy powder and a laminar flame-sprayed structure, in which lead is forcedly solid-dissolved in the copper alloy.

3. A swash plate of a swash-plate type compressor according to claim 1, characterized in that the flame-sprayed layer consists of a copper-based alloy containing from 1 to 30% by weight of lead and essentially consists of a mixed structure of an unmelted structure of a powder containing from 3 to 40% of lead and a melted structure containing not more than 3% of lead or free of lead.

4. A swash plate of a swash-plate type compressor according to claim 3, characterized in that lead phases in said unmelted structure are particulate in form.

5. A swash plate of a swash-plate type compressor according to claim 4, characterized in that said lead-containing powder is atomized powder.

6. A swash plate of a swash-plate type compressor according to any one of claims 1 through 5, characterized in that said flame-sprayed layer contains not more than 10% by weight of one or more compounds selected from a group consisting of $Al_2O_3$, $Sio_2$, SiC, $ZrO_2$, $Si_3N_4$, BN, AlN, TiN, TiC, $B_4C$, iron-based i.e., iron-phosphorus compound, iron-boron compound, and iron-nitrogen compound, as a compound for enhancing the wear resistance.

7. A swash plate of a swash-plate type compressor according to any one of claims 1 through 5, characterized in that said flame-sprayed layer contains not more than 3% by weight of graphite.

8. A swash plate of a swash-plate type compressor according to any one of claims 1 through 5, characterized in that, between said iron-based material or aluminum-based material and said flame-sprayed layer is formed an intermediate layer, which consists of one or more materials selected from a group consisting of Cu, Ni, Al, Ni—Al based alloy, Cu—Ni based alloy, Ni—Al based alloy, Cu—Al based alloy, Cu—Sn based alloy, Ni-based self-fluxing, and Co-based self-fluxing alloy.

9. A swash plate of a swash-plate type compressor according to claim 6, characterized in that said flame-sprayed layer contains not more than 3% by weight of graphite.

10. A swash plate of a swash-plate type compressor according to claim 6, characterized in that, between said iron-based material or aluminum-based material and said flame-sprayed layer is formed an intermediate layer, which consists of one or more materials selected from a group consisting of Cu, Ni, Al, Ni—Al based alloy, Cu—Ni based alloy, Ni—Al based alloy, Cu—Al based alloy, Cu—Sn based alloy, Ni-based self-fluxing, and Co-based self-fluxing alloy.

11. A swash plate of a swash-plate type compressor according to claim 10, characterized in that said flame-sprayed layer contains not more than 3% by weight of graphite.

12. A method for preparing a sliding layer of a swash-plate type compressor, wherein a powder of copper alloy containing lead is sprayed on a swash plate consisting of an iron-based or aluminum-based material, characterized in that said powder is the first powder mainly composed of copper and containing less than 3% by weight of lead or being free of lead, and the second powder mainly composed of copper and containing from 3 to 40% of lead, and, further, the first powder is melted, and the second powder coarser than the first powder is not essentially melted, when a layer is formed on the swash-plate.

13. A method for preparing a sliding layer of a swash-plate type compressor according to claim 12, wherein the flame-sprayed layer is subjected to peening.

14. A method for preparing a sliding layer of a swash-plate compressor according to claim 1, characterized in that the copper alloy according to claim 1 is further flame-sprayed, and, subsequently, the copper alloy are subjected to heat treatment in a temperature range of from 100° to 300° C. for 10 to 240 minutes.

15. A method for preparing a sliding layer of a swash-plate type compressor according to any one of claims 9 through 11, characterized in that an intermediate layer, which consists of one or more materials selected from a group consisting of Cu, Ni, Al, Ni—Al based alloy, Cu—Ni based alloy, Ni—Al based alloy, Cu—Al based alloy, Cu—Sn based alloy, Ni-based self-fluxing, and Co-based self-fluxing alloy is flame-sprayed on the surface of a swash-plate.

* * * * *